United States Patent [19]

Slaughter et al.

[11] 4,033,023

[45] July 5, 1977

[54] PROCESS FOR REFURBISHING METAL BUOYS

[76] Inventors: Albert E. Slaughter; Nan Burke Slaughter, both of P.O. Box 855, Guayama, P.R. 00654

[22] Filed: Oct. 8, 1975

[21] Appl. No.: 620,824

[52] U.S. Cl. ..... 29/401 B; 9/8 R; 264/36; 264/46.6; 264/46.9; 264/45.7

[51] Int. Cl.[2] ..... B23P 7/00; B63B 21/52; B63B 51/02

[58] Field of Search ..... 29/401 B; 9/8 R; 264/36, 46.6, 45.7, 46.9

[56] References Cited

UNITED STATES PATENTS

| | | | |
|---|---|---|---|
| 2,411,202 | 11/1946 | Gardner | 9/8 R |
| 2,795,523 | 6/1957 | Cobb et al. | 29/401 X |
| 3,132,417 | 5/1964 | Irwin | 9/8 R |
| 3,397,413 | 8/1968 | Houtsma | 9/8 R |
| 3,464,071 | 9/1969 | Starratt | 9/8 R |
| 3,488,783 | 1/1970 | Lockwood, Jr. | 9/8 R |
| 3,505,137 | 4/1970 | Kliene | 264/46.6 X |
| 3,533,531 | 10/1970 | Delahunt | 29/401 X |
| 3,728,749 | 4/1973 | Eby et al. | 9/8 R |
| 3,829,919 | 8/1974 | Mathae | 9/8 R |

*Primary Examiner*—C.W. Lanham
*Assistant Examiner*—V. K. Rising

[57] ABSTRACT

A procedure for refurbishing hollow metal buoys that have been surveyed out of service. The buoy repair method involves removing a metal section, filling the buoy interior with polyurethane foam, welding back the removed metal section and coating the metal exterior with fiber glass-resin composition. Buoys repaired in this manner are essentially maintenance free.

3 Claims, 2 Drawing Figures

PROCESS FOR REFURBISHING METAL BUOYS

BACKGROUND OF THE INVENTION

Metal marine buoys corrode in usage requiring periodic servicing. Such servicing involves locating leaks, repairing the leaks by sand blasting followed by welding and retesting to make sure the unit is leak free.

The repaired buoy is next painted the proper color and the submerged portion is given a coat of anti-fouling paint. The refurbished buoy is then returned to location. This process is repeated at regular intervals with the average time period between such refurbishing being about two years. Buoys that have suffered extensive corrosion are "surveyed out" of service.

The present invention provides a buoy repair method which greatly extends the life of metal buoys and decreases the frequency of repair. A bouy repaired by the method of our invention is essentially rust and corrosion proof, is unsinkable and is impervious to marine growth.

The buoy repair method of this invention involves the following steps: First, a large aperture or window is made in the shell of the buoy by cutting out a metal section. Then the interior of the hollow buoy is filled with urethane foam through the aperture. The third step involves welding back the cut-out metal section of the buoy shell after the interior is completely filled with urethane foam. Finally the metal exterior of the buoy is coated with a fiber glass-resin laminate and painted a color appropriate to its intended service.

It is known in the prior art to construct buoys or floats with inner cores of polyurethane foam. U.S. Pats. Nos. 3,121,889 and 3,728,749 described such type buoys. It has also been known to construct buoy housings of fiber glass as is taught in U.S. Pat. No. 3,674,225. However, we are the first to devise a metal buoy repair procedure involving the integral steps of filling the buoy interior with urehtane foam and coating its exterior with a fiber glass-resin composition.

Metal buoys repaired by the process of this invention should be essentially maintenance free in service. They do not require cleaning as the fiber glass coating is rust and corrosion free and is impervious to marine growth. Repainting may be necessary at 12 to 15-year intervals for colors other than black or white, for which the interval between paintings will be of significantly longer duration.

Urethane foams used in the repair process of the invention are formed by the reactions of isocyanates, usually toluene di-isocyanate, with a polyol in the presence of a catalyst such as a mixture of an amine and an organo metallic compound such as tin alkanoate. More detailed information on the formation of urethane foams is found in the Encyclopedia of Chemical Technology, Second Edition, Volume 21, page 56 et seq. Urethane foams have a low water absorption and excellent buoyancy.

The use of fiber glass-resin laminates in marine applications is well known. Fiber glass laminate-coated boat hulls have practically preempted the small boat market because of their reduced maintenance costs. Detailed information on fiber glass-resin laminates is found in the aforementined Encyclopedia, Volume 12, page 180 et seq.

Buoys repaired by the process of this invention only require periodic inspection of the mooring system. Their use involves significant savings in labor and maintenance.

Figure 1:
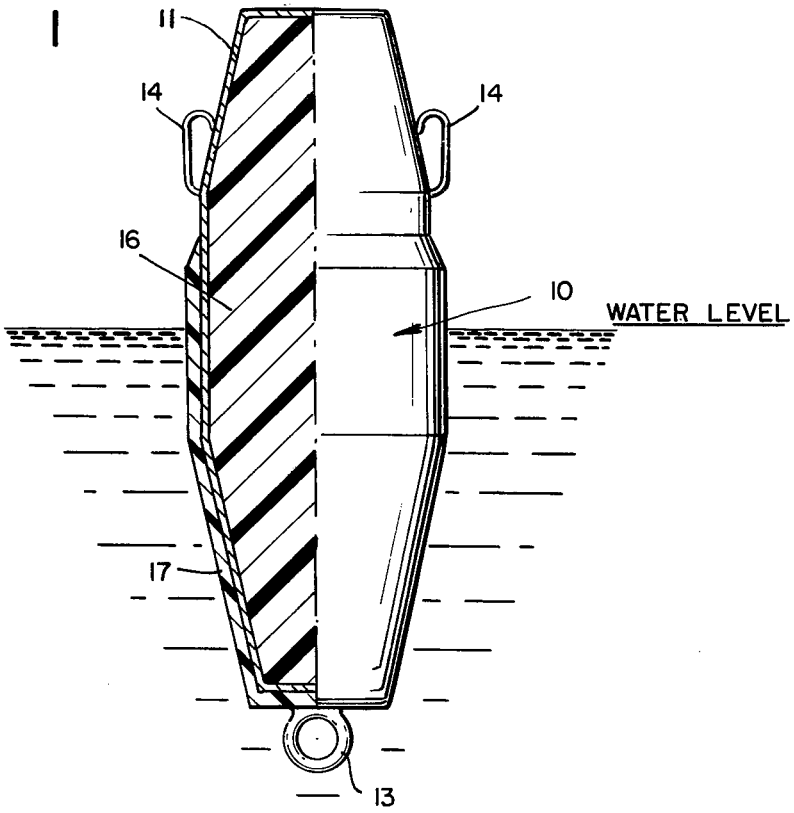
FIG. 1 is an elevation view of a buoy of the type contemplated, shown in partial cross sectionand subsequent to being repaired.

Referring to the drawings, the Figures illustrate the various steps followed during the instant refurbishing process. The Figures, for example, show a nun type buoy 10 embodying a steel shell 11 which defines an inner buoyancy chamber 12. The latter can include a ballasting material not presently shown, but which would be fastened into the buoy lower end.

An eyelet 13 or similar fitting, which depends from the buoy lower end, normally fastens to an anchor mooring chain or cable when the buoy is floating on location in a body of water. One or more lateral lifting rings 14 depend from shell 11, being positioned to permit the buoy to be conveniently hoisted from, or lowered into the water.

As shown in FIG. 1 the repaired buoy inner or flotation chember 12 is completely filled with a mass of expanded polyurethane foam 16. An outer coating 17 formed of multiple plies of a resin impregnated fiberglass provides a water tight skin to shell 11.

Figure 2:
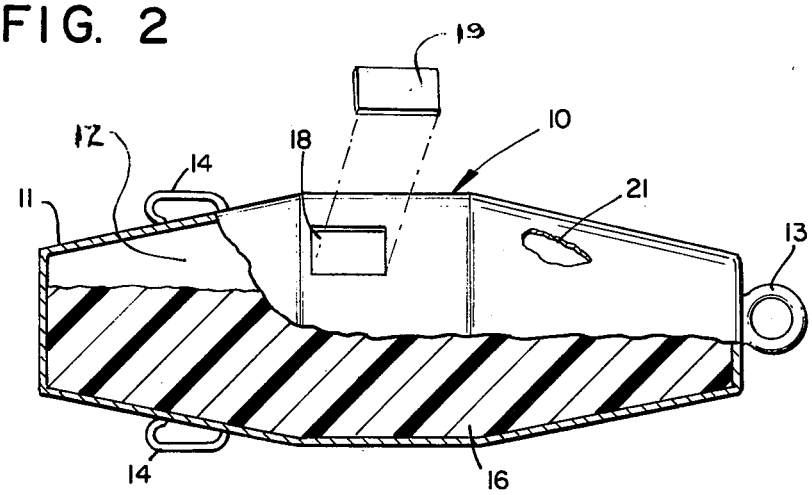
FIG. 2 illustrates in partial cross section, the buoy of FIG. 1 prior to being repaired but with an aperture formed in the metal shell for insertion of the urethane foam filler material.

Referring to FIG. 2, the buoy 10 is shown having an aperture 18 formed by removal of a closure section 19. A break or fracture of shell 11 is shown as item 21. Said break, whether a fracture, or a corroded area of the shell, ordinarily necessitates the presently described repair procedure.

Metal buoys that have been surveyed out of service because of extensive corrosion can be rehabilitated by the process of this invention. The procedure for "junked" metal buoys is the same as described above and involves filling the buoy with urethane foam through an aperture, welding back the cut-out flap and laminating the exterior of the buoy with multi-layers of fiber glass-resin.

The following example illustrates the refurbishing of a metal buoy by the process of the invention:

A corroded metal buoy 10 was placed in a position to expedite filling of the interior with foam. An aperture 18 of sufficient size to accomodate the urethane foam precursor from a five-gallon can was then formed on the top side of the buoy by cutting out a metal section 19. Aperture sizes of 1×1 foot to 2×2 foot are usually employed and permit pouring the foam precursor from a five-gallon can or spraying the precursor through a mixing nozzle.

Two pounds of polyurethane foam precursor — a toluene di-isocyanate-polyol mixture — was used per cubic foot of buoy interior. A catalyst was added in an amount equal to about ¼ ounce per pound of liquid polyurethane foam precursor. The liquid foam precursor-catalyst mixture was poured into the buoy interior in one-gallon increments every 2 to 3 minutes. Each gallon increment required about 1 to 1½ minutes to expand and about an equal time to harden. Liquid polyurethane foam precursors and catalysts are available from Union Carbide, Dow Chemical, PPG Industries, Upjohn and others.

When the buoy interior was filled with foam, the metal section 19 was welded back into place closing the aperture 18. The buoy was then prepared for the fiber glassing by cleaning off the marine growth and loose scale with an ordinary scraper. The buoy was rusty and pitted and no effort was made to fill the pinholes or rusted-through spots. Sand blasting was not necessary since a rough surface favors the adhesion of the fiber glass.

After drying polyester resin was applied to the exterior of the buoy with a paint roller. Prior to application a catalyst was mixed with the polyester resin as specified by the manufacturer; for example, ½ ounce of peroxide catalyst per gallon of polyester resin. The polyester resin used was Laminace No. 4155-A made by American Cyanamid. A layer of chopped mat fiber glass was added to area coated with polyester resin in a concentration of 1½ ounces per square foot of surface. After throughly wetting with another coating of polyester resin and rolling to remove air bubbles, a layer of woven fiber glass cloth weighing 16 ounces to the square foot was laid down over the 1st layer of mat. Successive layers of mat and woven fiber glass cloth were applied with intermediate coatings of polyester resin until a final layer of mat was applied followed by a coating of polyester resin applied with a roller to remove air bubbles. At least five layers of fiber glass are used for buoys up to 6 feet in diameter and at least seven layers of buoys up to 9 feet to form the auter coating 17.

After one side of the buoy was finished and allowed to dry about 24 hours, it was turned over and the other side was fiber glassed in similar manner making sure to have several inches of overlap. After the fiber glass-resin mixture cured for 24 hours a pigmented coat of resin was applied to the section of the buoy above the water line. This gel coat was of an appropriate color to the intened use of the buoy. The buoy treated as above was ready for return to services without any further treatment.

We claim:

1. A method for repairing corroded metal buoys which comprises removing a metal section to form an aperture in said buoy, filling the interior of the buoy through said aperture with polyurethane foam which is foamed in place from a foam precursor-catalyst mixture, replacing and rewelding said metal section, scraping marine growth and scale from said buoy exterior, and coating the exterior of said buoy with multiple plies of fiber glass-resin laminate.

2. A method according to claim 1 in which said fiber glass-resin coated buoy is painted a color appropriate for the buoy service.

3. A method according to claim 1 in which the exterior is coated with at least five layers of fiber glass coated with resin.

* * * * *